United States Patent [19]

Crawford et al.

[11] Patent Number: 4,976,314

[45] Date of Patent: Dec. 11, 1990

[54] T-SLOT MANDREL AND KICKOVER TOOL

[76] Inventors: William B. Crawford, 14135 Champions Dr., Apt. 113, Houston, Tex. 77069; Perry Decuir, Sr., P.O. Box 721, New Iberia, La. 70561-0721

[21] Appl. No.: 385,965

[22] Filed: Jul. 28, 1989

Related U.S. Application Data

[63] Continuation of Ser. No. 151,654, Feb. 3, 1988, abandoned.

[51] Int. Cl.[5] ..... E21B 23/03

[52] U.S. Cl. ..... 166/117.5

[58] Field of Search ..... 166/117, 117.5, 117.6, 166/162

[56] References Cited

U.S. PATENT DOCUMENTS

| | | | |
|---|---|---|---|
| Re. 32,441 | 6/1989 | Higgins et al. | 166/117.5 |
| 2,988,146 | 6/1961 | Fredd | 166/117.5 |
| 4,508,165 | 4/1985 | Foust | 166/117.5 |

FOREIGN PATENT DOCUMENTS

| | | | |
|---|---|---|---|
| 8603544 | 6/1986 | PCT Int'l Appl. | 166/117.5 |

*Primary Examiner*—Ramon S. Britts
*Assistant Examiner*—Terry Lee Melius
*Attorney, Agent, or Firm*—Dodge, Bush & Moseley

[57] ABSTRACT

In accordance with illustrative embodiments of the present invention, a side pocket mandrel includes an orienting sleeve having guide surfaces that lead to a longitudinal slot which forms, together with an adjacent longitudinal recess in the mandrel, a T-shaped channel that cooperates with projections on the arm of a kickover tool to precisely align the gas lift valve with the receptacle bore in the mandrel. The kickover tool includes an assembly of pivotally mounted upper and lower arms with the lower arm being pivoted to the tool body. The lower arm includes a locating finger and transversely extending projections that engage and slide in a T-shaped channel of the mandrel to achieve precise alignment of the valve with the receiver bore.

31 Claims, 3 Drawing Sheets

FIG. 1
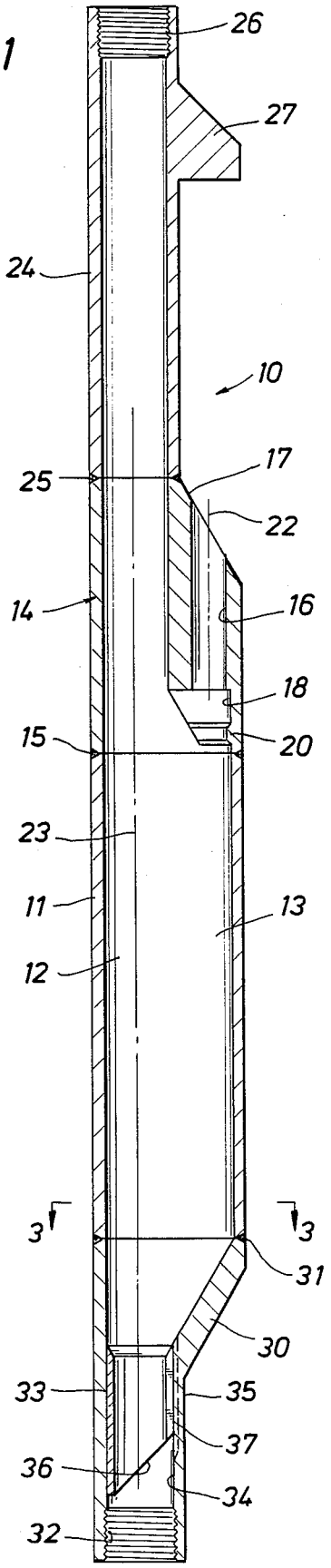
FIG. 2
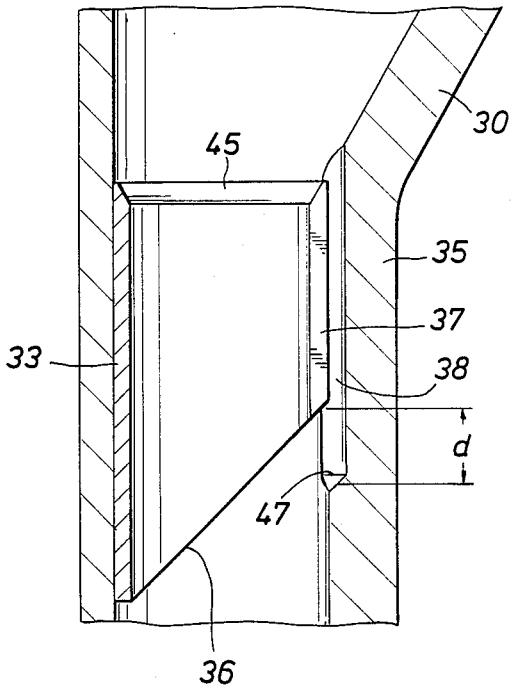
FIG. 3
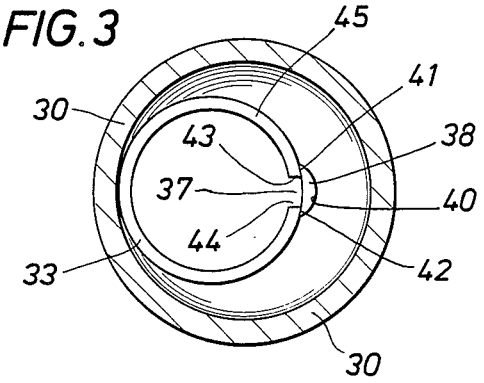
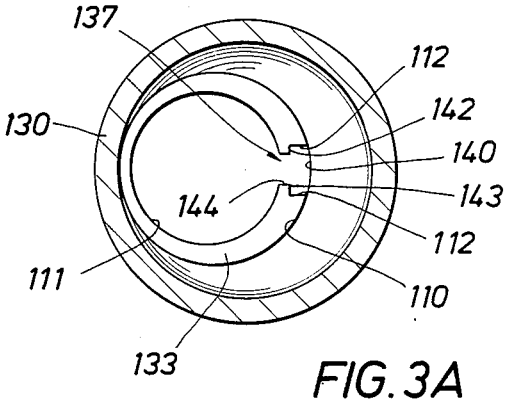
FIG. 3A

FIG. 4A
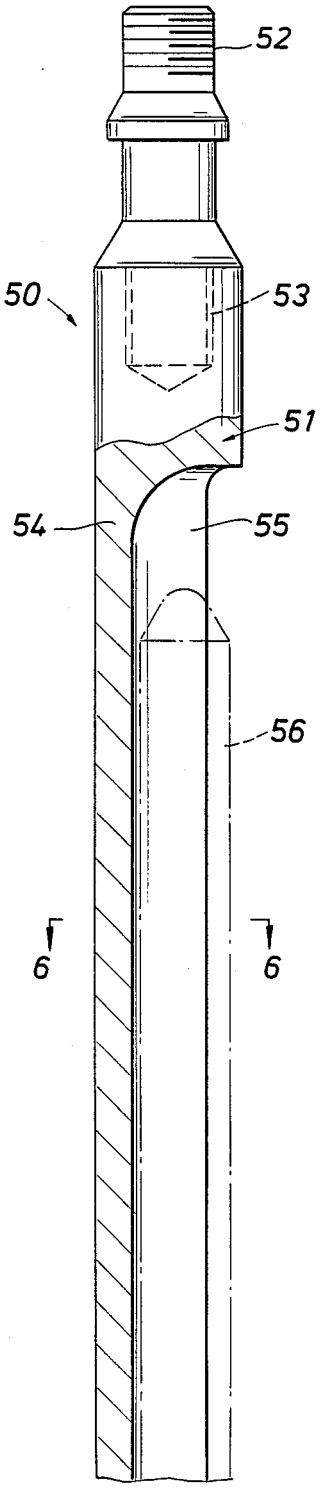
FIG. 4B
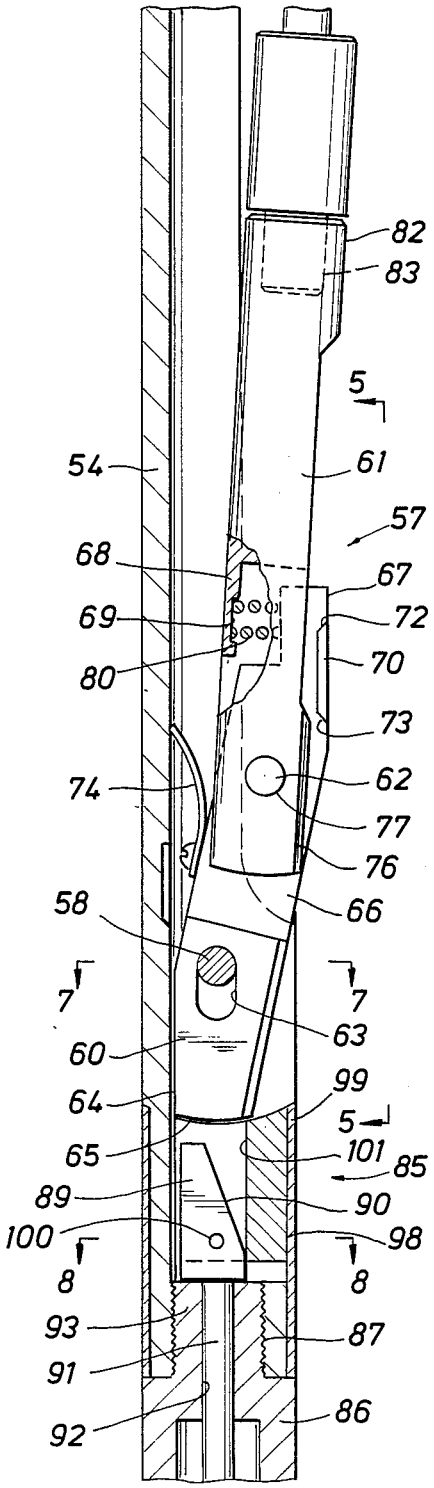
FIG. 4C
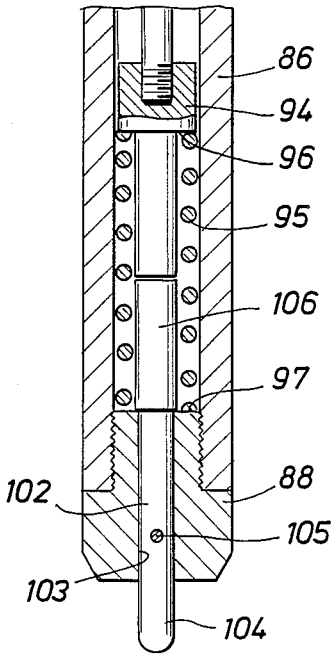
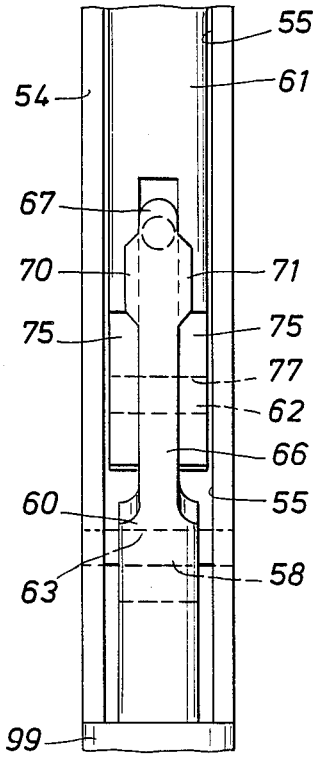
FIG. 5

FIG.6
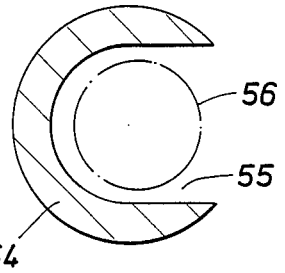
FIG.7
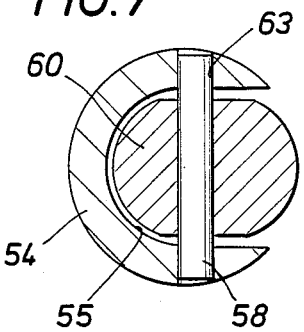
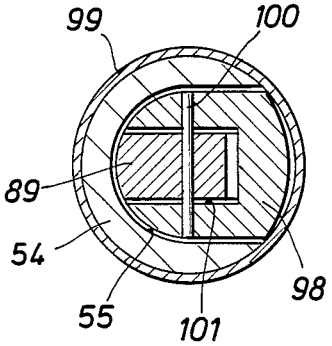
FIG.8
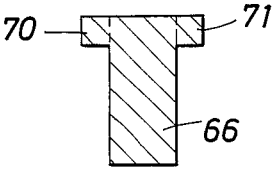
FIG.9
FIG.10
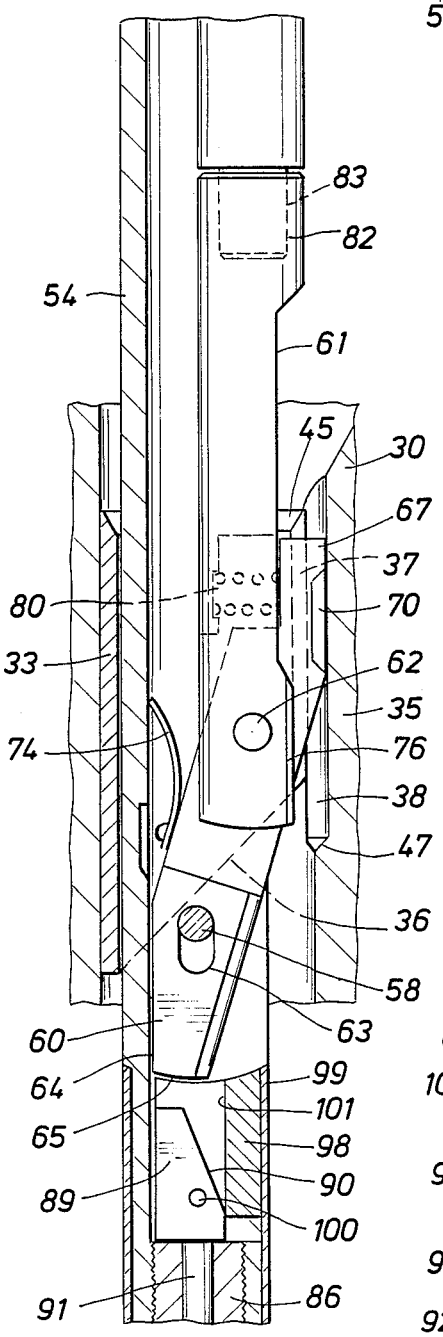
FIG.11
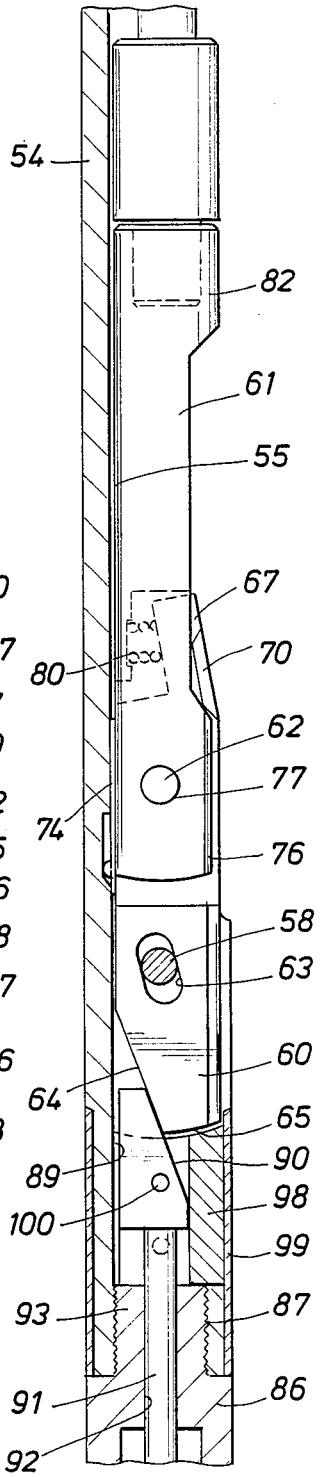

T-SLOT MANDREL AND KICKOVER TOOL

This application is a continuation, of application Ser. No. 151,654, filed Feb. 3, 1988, now abandoned.

FIELD OF THE INVENTION

The present invention relates generally to side pocket mandrel and kickover tool apparatus for placing and removing flow control devices in wells, and particularly to a new and improved side pocket mandrel having a unique channel and orienting sleeve combination for positively orienting and actuating a kickover tool being moved through the mandrel. The present invention also provides a new and improved kickover tool having an arm assembly that is oriented and pivoted outwardly due to cooperative engagement with a channel and sleeve in the mandrel.

BACKGROUND OF THE INVENTION

Side pocket mandrels are used extensively in producing oil wells in connection with artificial lift operations such as gas lift. A series of mandrels are spaced vertically in the production string of tubing that extends down into the well, and each mandrel has an offset pocket that is arranged to receive a gas lift valve that can be placed therein, and removed therefrom, through use of a wireline kickover tool. The kickover tool generally has an articulated arm assembly that is pivotally attached to an elongated tray, and an orienting and trigger mechanism that cooperates with a slot and shoulder in a "mule-shoe" orienting sleeve to rotationally orient the arm assembly with respect to the side pocket, and to release the arm assembly to pivot outward so that a flow control device coupled thereto can be inserted into the pocket. Once the flow control is latched in place, the arm assembly is released therefrom to permit the kickover tool to be removed from the well. Various United States Patents which illustrate typical prior devices are 2,824,525, 3,268,006, 3,741,299, 3,802,503, 4,106,503 and 4,106,564. More recent improvements in the art are disclosed and claimed in U.S. Pat. Nos. 4,715,441 and 4,765,403, filed in behalf of one or more of the present inventors.

In this art, reliability of tool performance downhole is of critical importance. Since the mandrel may be located many thousands of feet below the earth's surface, a kickover tool malfunction which results in an inability to set or remove a flow control device can cause very time consuming and costly workover procedures to have to be undertaken. As in many other mechanical arts, reliability of downhole performance is often directly related to the degree of simplicity of tool design, because the number of possible malfunctions usually increases with complexity. Thus there is a continuing need in this art for equipment of simple and reliable design.

An object of the present invention is to provide a new and improved side pocket mandrel having an orienting sleeve and channel construction that provides improved reliability of kickover tool operation and performance.

Another object of the present invention is to provide a new and improved kickover tool having a unique arm assembly that co-acts with an orienting sleeve and channel in a side pocket mandrel to assure positive and reliable setting and retrieval of a flow control device.

SUMMARY OF THE INVENTION

These and other objects are attained in accordance with the concepts of the present invention through the provision of a side pocket mandrel having an open bore aligned with the bore of the tubing, and an elongated internal recess, or pocket, laterally offset from such open bore. A seal or polish bore at the upper end of the pocket extends through the wall of the mandrel and is arranged to receive the packing of a valve body that is inserted through the bore by operation of a kickover tool. An orienting sleeve having helical lower guide surfaces that lead to a vertical slot in the sleeve wall is fixed in a lower end section of the mandrel, and a longitudinal recess or channel is formed that is wider than the slot to provide an essentially "T-shaped" vertically extending recess.

The kickover tool has an upwardly extending, outwardly biased arm assembly that is pivotally mounted on an elongated tray. The arm assembly includes a lower arm having a locator finger on its upper end, and oppositely directed projections located immediately below the finger. The lower arm is biased outward, so that as the tool is moved upward through the mandrel, the finger engages one or the other of the helical surfaces on the orienting sleeve to cause the arm to be rotationally oriented to a predetermined position. The projections then enter the channel which extends outside of the sleeve slot so that the arm is positively held in an outer position during further upward movement. With the arm in such outer position, the nose of a flow control device coupled thereto is very precisely aligned with the seal bore at the upper end of the pocket, and is inserted therethrough as the tool is moved upward in the mandrel. After the flow control device is latched in place, jarring forces can be applied to disconnect from the latch on the flow control, and to release a wedge-type lock. As the kickover tool is moved downward in the mandrel, the arm is forced inward and locked in an inner position by such wedge. Then the kickover tool can be retrieved from the tubing. A secondary lock actuating mechanism also is provided to allow the arm assembly to be locked in its pivotally retracted position during such removal.

The present invention eliminates the various power springs, cores, trigger assemblies and the like which typically have been used in prior devices of this type. The result is an overall substantial simplification in kickover tool design, with greatly increased reliability.

BRIEF DESCRIPTION OF THE DRAWINGS

The present invention has other objects, advantages and unique features which will become more clearly apparent in connection with the following detailed description of preferred embodiments, taken in conjunction with the appended drawings in which:

FIG. 1 is a longitudinal sectional view of a side pocket mandrel in accordance with this invention;

FIG. 2 is an enlarged, fragmentary cross-sectional view of the channel and slot arrangement;

FIG. 3 is an enlarged section taken on line 3—3 of FIG. 1;

FIG. 3A is a view similar to FIG. 3 but showing another embodiment of a T-slot;

FIGS. 4A through 4C are longitudinal sectional views, with some portions in side elevation, of the kickover tool of the present invention;

FIG. 5 is a side elevation view on lines 5—5 of FIG. 4B;

FIGS. 6—8 are respective sections taken on lines 6—6, 7—7 and 8—8 of FIGS. 4A and 4B;

FIG. 9 is a cross-section showing the projecting ears on the lower arm of the kickover tool;

FIG. 10 is a longitudinal sectional view showing the arm assembly of the kickover tool being positively oriented and positioned by cooperation of projections thereon with the channel and slot arrangement of the mandrel; and FIG. 11 is a view similar to FIG. 4B showing the arm assembly locked in retracted position.

DETAILED DESCRIPTION OF PREFERRED EMBODIMENTS

Referring initially to FIG. 1, a side pocket mandrel 10 in accordance with the present invention includes an elongated body section 11 that is generally tubular, and which defines a main bore 12 and a side pocket region 13 that is offset laterally to the side of such main bore. A short-length valve seating sub 14 is welded at 15 to the upper end of the body 11, and has a polish bore receptacle 16 that opens to the outside of the mandrel 10 through an outer inclined surface 17 thereof. An enlarged diameter section 18 at the lower end of the bore 16 provides a latch recess, and an inwardly directed, arcuate shoulder 20 is arranged to cooperate with a latch mechanism to hold a flow control device (not shown) that extends through the bore 16. The packing on the flow control device engages the walls of the bore 16 to prevent fluid leakage. The axis 22 of the bore 16 can be inclined downward and inward toward the axis 23 of the bore 12 at a small angle, for example 1°-3°. A tubular nipple 24 has its lower end welded at 25 to the upper end of the seating sub 14, and is provided with internal threads 26 at its upper end for connection to the tubing. If desired, an outwardly directed lug 27 can be provided to protect the nose of the flow control device from damage due to impact during pipe handling.

A swage nipple 30 is welded at 31 to the lower end of the main body section 11. The nipple 30 has internal threads 32 at its lower end for connection to the tubing string. An orienting sleeve 33 is fixed in a suitable manner inside the bore 34 of the lower portion 35 of the swage nipple 30, and has a pair of helical lower surfaces 36 that lead upward to an open-ended slot 37 in the sleeve 33. As shown in enlarged detail in FIGS. 2 and 3, the slot 37 is rotationally oriented so as to overlay an elongated, vertically disposed recess 38 that is formed in the wall of the lower portion 35. The recess 38 has a generally semi-circular cross-section to provide a concave outer wall surface 40, and the width of the inner portion of the recess is substantially greater than the width of the sleeve slot 37. The arrangement of parts provides a generally T-shaped, elongated channel whose walls are defined by the outer wall surface 40, the outer surfaces 41, 42 of the sleeve 33 to the sides of the slot 37, and the opposed wall surfaces 43, 44 of the slot 37. As shown in FIG. 2, the upper end of the channel 38 opens into the side pocket region 13 above the inclined upper end surface 45 of the sleeve 33, and the lower end portion 47 of the channel extend a distance d below the lower end of the slot 37. If desired, the lower end surface of the channel 38 can be inclined downward and inward toward the axis of the lower portion 35 of the swage nipple 30.

Another structural arrangement forming a T-shaped channel is shown in FIG. 3A. In this case the orienting sleeve 133 fits in an eccentrically arranged counterbore 110 in the swage nipple 130, the centerline of the cylindrical inner wall surface 111 of the sleeve being aligned with the axis 23 of the mandrel bore 12. The longitudinal slot 137 in sleeve 133 is widened to the outside as shown to provide a pair of transverse wall surfaces 141, 143 and a second pair of side wall surfaces 112 that extend parallel to the side walls 144 of the slot 137. These wall surfaces, together with the adjacent inner wall surface 140 of the swage nipple 130 provide a T-shaped channel similar to that shown in FIG. 3, except that there are no acute corners in which a wireline might become lodged.

A kickover tool 50 in accordance with the present invention is shown in FIGS. 4A, 4B and 4C. The tool 50 includes an elongated body or tray 51 having a threaded connector sub 52 for a wireline socket at its upper end. The sub 52 can be threaded at 53 to the upper end of the tray body 54. The body 54 is provided with an elongated recess 55 that receives a flow control device 56 as shown in phantom lines, which can be a gas lift valve, a dummy, or the like. A kickover arm assembly indicated generally at 57 in FIG. 4B is attached by a transverse pivot pin 58 near the lower end of the recess 55.

The arm assembly 57 includes a lower arm 60 having an upper arm 61 pivotally attached thereto by a pin 62. The lower arm 60 has an elongated slot 63 through which the mounting pin 58 extends to enable a degree of upward movement of the tray 51 relative to the lower arm. The lower portion of the arm 60 has an inclined rear surface 64, and a lower end surface 65 that is rounded on a large radius. As shown in FIG. 5, the upper portion 66 of the arm 60 has a reduced wall thickness and terminates in a rounded end portion or finger 67. The upper outer edge of the portion 66 is inclined upward and inward as shown. Suitable means such as a leaf spring 74 is secured to the arm 60 above the pin 58 in a manner such that the free end of the leaf spring slidably engages a back wall surface of the recess 55. Thus arranged, the leaf spring 74 urges the arm 60 to pivot in a clockwise direction about the pin 58, as viewed in FIG. 4B.

A pair of oppositely projecting ears 70, 71 are formed on the upper portion 66, with each ear having oppositely inclined upper and lower end surfaces 72, 73. A transverse section through the end portion 66 and the ears 70, 71 has a T-shaped configuration as shown in FIG. 9. The width of the leg of the "T" is slightly less than the width of the slot 37 in the orienting sleeve 33, and the height and transverse dimensions of the top of the "T" is sized such that it will fit with somewhat loose tolerance within the channel 38 in the swage nipple 30.

As shown in FIG. 5, the upper arm 61 of the assembly 57 has a pair of legs 75 that are spaced apart so as to receive the upper portion 66 of the lower arm 60 therebetween. An outer surface 76 of each leg 75 is formed to have substantially the same radius as the inner wall surface of the orienting sleeve 33. Aligned apertures 77 in the legs 75 receive the respective ends of the pivot pin 62. A ledge 68 on the upper arm 61 has a shallow depression 69 that receives the inner end of a compressed coil spring 80 that reacts against an inwardly facing surface 81 on the upper end portion 67 of the lower arm 60. Since the spring 80 is located above the pivot pin 62 the spring functions to urge the upper end of the arm 61, and thus the upper end of the flow control device 56, to pivot toward the tray 51. The upper section 82 of the arm 61 is provided with an internally threaded socket 83 to which a typical running or retrieving head (not shown in detail) is attached. Of course the head is coupled to a latch mechanism that is attached to the lower end of the flow control device 56.

In order to lock the arm assembly 57 in its inner position once the setting of a flow control device has been accomplished, a mechanism indicated generally at 85 in FIG. 4B is secured to the lower end of the tray 51. The mechanism 85 includes a tubular housing 86 having its upper end threaded to the tray 51 at 87, and its lower end closed by a bottom plug 88 (FIG. 4C). A wedge 89 having an upward and inwardly inclined surface 90 is mounted on the upper end of a rod 91 that is slidably received in a central opening 92 in the upper section 93 of the housing 86. The lower end of the rod 91 is threaded to a plunger 94 that is biased upward by a coil spring 95 which reacts between a downwardly facing shoulder 96 on the plunger 94 and an upwardly facing shoulder 97 on the bottom plug 88. As shown in FIGS. 4B and 8 the wedge 89 is releasably coupled to a block 98 on the lower end portion of the tray 51 by a shear pin 100. The upper surfaces of the block 98 are concave as shown, and slidably engage the companion curved lower surface of the arm 60. The wedge 89 fits within a longitudinal slot 101 in the block 98. A tubular sleeve 99 can be arranged on the lower portion of the tray 51 to provide a guide for the block 98. The lower end surface of the block 98 normally is spaced upward with respect to the upper surface of the housing 86 by a distance that is less than the major length of the pin slot 63 in the lower arm 60.

A release rod 102 (FIG. 4C) extends through a central opening 103 in the bottom plug 88 in a manner such that the lower end portion 104 thereof projects below the lower end of the plug. Another shear pin 105 is used to releasably attach the release rod 102 to the bottom plug 88. The upper section 106 of the rod 102 has an enlarged diameter to limit downward movement with respect to the plug 88.

OPERATION

In operation, a number of the side pocket mandrels 10 are connected in the well production tubing at selected, vertically spaced locations. To set a flow control device 56, such as a gas lift valve, in one of the mandrels 10, the kickover tool 50 is assembled as shown in the drawings, and the valve and latch are attached by a running head to the upper end 82 of the arm 61. The kickover tool 50 then is attached by sinker bars and a set of jars to the end of the wireline, and lowered into the tubing. As the tool enters the top joint of the tubing, the arm assembly 57 is tucked in so that the arms and the valve lie within the elongated recess 55 of the tray body 54. The leaf spring 74 causes the upper outer surface 67 of the lower arm 60 to slide gently along the inner wall of the tubing as the tool 50 is lowered into the well.

When the kickover tool 50 has been lowered to a point below the mandrel 10 in which the valve 56 is to be set, the tool is stopped, and then raised slowly upward. The upper end portion 67 or "finger" of the lower arm 60 will engage a helical lower surface 36 on the orienting sleeve 33, which causes the entire kickover tool 50 to rotationally index until the finger is aligned with the slot 37 (or 137 in the case of the embodiment shown in FIG. 3A). As the finger 67 enters the slot 37, the spring 74 causes the upper end of the arm 60 to pivot further outward so that the ears 70, 71 enter the lower end of the T-shaped channel 38 as shown in FIG. 10. As this occurs, the upper end, or nose, of the gas lift valve 56 is tilted outward into precise alignment with the seating bore 16 due to sliding engagement of the outer wall surfaces 76 of the upper arm 61 with the inner wall surfaces of the orienting sleeve 33 to either side of the slot 37. The nose of the valve enters such bore as the ears 70, 71 transverse the channel 38. In this manner, the valve 56 is positively positioned and held in the proper alignment during such entry. The tool 50 is raised further upward to complete the valve setting operation, and until the latch automatically engages in the region 18 above the shoulder 20. An upward jarring blow then is applied to shear the pin 100 that secures the wedge 89 to the block 98. When this occurs, the block 98 moves relatively downward and against the upper end surface of the housing 86, which positions the nose of the wedge 89 against the lower surface 64 of the arm 60. The coil spring 95 biases the plunger 94, the rod 91 and wedge 89 upward, however upward movement temporarily is prevented by engagement of the wedge with the arm surface 65. A downward jarring blow is applied to shear one or more shear pins that connect the running head to the latch assembly.

To remove the kickover tool 50 from the tubing with the arm assembly 57 locked in its inner position, the tool is lowered in the mandrel 10 until the arm engages the inner inclined surface of the swage nipple 30. Further downward movement causes the arm 60 to pivot inward about the pin 58 until it is approximately aligned with the axis of the body 54. As such pivoting occurs, the wedge 89 is forced upward by the spring 95 to position the inclined surfaces 90 and 64 in contact with one another as shown in FIG. 11. The ears 70, 71 force the upper arm 61 inwardly to a retracted position, so that both arms are locked in the inner position by the wedge 89. The kickover tool 50 then can be raised to the surface in a condition such that neither arm can hang up on any shoulder that may be present in the tubing.

Another means of locking the arms 60, 61 in retracted position is to lower the kickover tool 50 until the bottom plug 88 encounters a stop that normally is placed in the tubing in preparation for a wireline operation. When the lower rod 104 engages the stop, the pins 105 and 100 are sheared, which allows the power spring 95 to extend and force the wedge 89 upward. At this point, the arms 60, 61 are being held retracted by the inner wall of the tubing. The inclined surface 90 of the wedge 89 enters behind the lower end portion of the lower arm 60 as described above, and functions to lock the arms 60 and 61 in their inner or retracted positions. In such condition, the kickover tool 50 can be removed from the tubing well with ample clearance between the outer surfaces of the arms and the inner wall surfaces of the tubing.

It now will be recognized that a new and improved side pocket mandrel and kickover tool have been provided. The apparatus is relatively simple in construction and operation, to greatly enhance downhole reliability. Since the T-shaped projection of the lower arm of the kickover tool engages and slides in a channel in the mandrel, the arm assembly and valve are positively positioned in accurate alignment with the valve seating bore. During setting, the lower arm rests on the block, which engages the kickover tool body, so that impact jarring blows are not applied to the lower pivot pin.

After setting has been accomplished, the arms are locked in retracted position by lowering the tool in the mandrel, or by engagement with a stop in the tubing.

Since various changes or modifications may be made in the disclosed embodiments without departing from the concepts involved, it is the aim of the appended claims to cover all such changes and modifications falling within the true spirit and scope of the present invention.

What is claimed is:

1. A side pocket mandrel, comprising: an elongated, generally tubular body having means at its opposite ends for connecting said mandrel in a pipe string, said body having a main bore and a receptacle laterally offset to the side of said main bore for receiving a flow control device; orienting means in said body, said orienting means including helical guide surfaces leading to a longitudinal slot, said guide surfaces and slot orienting a kickover tool moving longitudinally within said bore; and longitudinally extending channel means formed at least in part in one of said orienting means and said body adjacent said slot, said channel means being wider than said slot to define a guideway that causes the arm of a kickover tool to be held in an extended position as the kickover tool is moved longitudinally within said bore of said mandrel.

2. The mandrel of claim 1 wherein said receptacle and said sleeve are located adjacent respective opposite ends of said body.

3. The mandrel of claim 2 wherein said receptacle is located adjacent the upper end of said body, and said sleeve is located adjacent the lower end of said body.

4. The mandrel of claim 3 wherein said receptacle includes a bore that extends upward through the wall of said body, said bore being adapted to be engaged by packing means on a flow control device.

5. The mandrel of claim 4 wherein the longitudinal axis of said bore is inclined at a small angle downward and inward with respect to the longitudinal axis of said main bore.

6. A side pocket mandrel, comprising: an elongated, generally tubular body having means at its opposite ends for connecting said mandrel in a pipe string, said body having a main bore and a receptacle laterally offset to the side of said main bore for receiving a flow control device; an orienting sleeve fixed in said body and having guide surfaces leading to a longitudinal slot; and longitudinally extending channel means adjacent said slot for causing the arm of a kickover tool to be held in an extended position as the kickover tool is moved within said bore of said mandrel, said channel means including a longitudinal recess having a width greater than the width of said slot to define, together with the side walls of said slot, a generally T-shaped opening.

7. The mandrel of claim 6 wherein said channel means extends in said body from a first point adjacent one end of said slot to a second point located a selected distance beyond the other end of said slot.

8. The mandrel of claim 7 wherein said guide surfaces are formed and lead helically upward to the lower end of the slot, said second point being below said other end of said slot.

9. The mandrel of claim 8 wherein said sleeve and channel means are located adjacent the lower end of said body, and said receptacle is located adjacent the upper end of said body.

10. The mandrel of claim 9 wherein said receptacle is formed in a short-length seating sub that is formed as an integral part of the upper section of said body, said receptacle including a seal bore that extends upward through the wall of said sub to the exterior of said mandrel.

11. The mandrel of claim 10 wherein said receptacle further includes a latch recess having a diameter greater than the diameter of said seal bore, said latch recess being located adjacent the lower end of said seal bore, and further including an inwardly projecting, arcuate latch shoulder at the lower end of said latch recess.

12. A kickover tool apparatus comprising: an elongated, generally tubular body having a recess outwardly along one side thereof; a first arm having one end pivotally attached to said body adjacent one end of said recess, the other end of said arm being arranged to move between an inner position and an outer position with respect to said body; projecting means on said other end of said first arm defining inwardly facing surface means adapted to engage a channel in a side pocket mandrel to positively hold said other end of said first arm in said outer position; and selectively operable means for locking said other end of said first arm in said inner position.

13. The apparatus of claim 12 further including resilient means for biasing said outer end of said arm toward said outer position.

14. The apparatus of claim 13 further including a second arm pivotally attached to said first arm, said second arm having means for connecting it to a head that is releasably coupled to a flow control device.

15. The apparatus of claim 14 wherein said resilient means is a spring arranged to react between said first and second arms.

16. A kickover tool apparatus comprising: an elongated, generally tubular body having a recess opening outwardly along one side thereof; a first arm having one end pivotally attached to said body adjacent one end of said recess, the other end of said arm being arranged to move between an inner position and an outer position with respect to said body; and projecting means on said arm adapted to engage a channel in a side pocket mandrel to positively hold said arm in said outer position, said projecting means including a pair of outwardly directed ears located on opposite sides of said first arm at the outer edge thereof to provide a configuration such that a section through said arm and said ears has a T-shape.

17. The apparatus of claim 16 wherein a portion of said other end of said arm extends beyond said pair of ears to provide a locating finger.

18. The apparatus of claim 17 further including a second arm pivotally attached to said first arm and adapted to be connected to a running or retrieving head, and spring means for biasing said first and second arms outwardly.

19. The apparatus of claim 18 wherein the pivoted end portion of said second arm has a pair of spaced apart, parallel legs, said other end of said first arm being received between said legs, said second arm having recessed means on its outer side arranged to receive said ears when said first and second arms are in substantial alignment with one another.

20. Well apparatus comprising: a side pocket mandrel having a main bore and a receptacle laterally offset to the side of said main bore for receiving a flow control device; orienting means on said mandrel and defining with said mandrel a longitudinally extending guideway having outwardly facing guide surfaces; a kickover tool assembly adapted to pass through said main bore and including a body having a first arm mounted thereon, said first arm having one end pivotally attached to said body and another end movable between an inner position and an outer position with respect to said body; means urging said other end of said first arm toward said outer position; and means on said other end of said first arm having inwardly facing guide surfaces arranged to be received within said guideway in sliding relation to said outwardly facing guide surfaces to positively hold said other end of said first arm in said outer position to enable a flow control device coupled thereto to be placed in said receptacle.

21. A kickover tool apparatus comprising: an elongated, generally tubular body having a recess opening outwardly along one side thereof; a first arm having one end pivotally attached to said body adjacent one end of said recess, the other end of said arm being arranged to move between an inner position and an outer position with respect to said body; projecting means on said arm adapted to engage a channel in a side pocket mandrel to positively hold said arm in said outer position; and selectively operable means for locking said first arm in said inner position, said locking means comprising normally restrained wedge means on said body, resilient means for forcing said wedge means toward locking engagement with said first arm, and release means for enabling said wedge means to move into engagement with said first arm to lock said first arm in said inner position.

22. The apparatus of claim 21 wherein said wedge means includes a head having an inclined outer surface thereon, said first arm having a companion inclined inner surface, said inclined surfaces engaging one another upon operation of said release means.

23. The apparatus of claim 22 further including a guide block slidably mounted on said body adjacent said one end of said first arm, said guide block having a longitudinal groove for receiving said wedge means, and concave curved end surfaces that are slidably engaged by convex curved end surfaces on said one end of said first arm, said release means comprising a shearable member for securing said wedge means to said guide block with said inclined surfaces spaced away from one another.

24. The apparatus of claim 23 wherein said release means further comprises a release actuator that projects beyond an end of said body, a second shearable member for securing said actuator to said body, said actuator being arranged such that impact thereof against a stop in a pipe string causes shearing of said second member as well as said first member to enable said wedge means to lock said first arm in said inner position.

25. The apparatus of claim 21 further including a second arm having one end pivotally connected to said other end of said first arm, said second arm being movable between an inner position and an outer position with respect to said body; and means including said projecting means for holding said second arm in its said inner position when said first arm is locked in its said inner position by said locking means.

26. The apparatus of claim 25 further including spring means for biasing said first and second arm toward said outer positions.

27. Well apparatus comprising: a side pocket mandrel having a main bore and a receptacle laterally offset to the side of said main bore for receiving a flow control device; an orienting sleeve fixed in said mandrel and having guide surfaces leading to a longitudinal slot; channel means in said mandrel adjacent said slot and defining therewith a generally T-shaped, longitudinally extending recess; a kickover tool assembly adapted to pass through said main bore and including a body having a first arm mounted thereon, said first arm having one end pivotally attached to said body and another end movable between an inner position and an outer position with respect to said body; means urging said other end of said first arm toward said outer position; and projecting means on said other end of said first arm arranged to engage said T-shaped, longitudinally extending recess in said mandrel to positively hold said first arm in said outer position and enable a flow control device coupled thereto to be placed in said receptacle.

28. The apparatus of claim 27 further including a second arm pivotally attached to said other end of said first arm, said second arm having outer surface means thereon engageable with inner surfaces of said orienting sleeve adjacent said longitudinal slot for aligning said second arm in a precise manner with respect to said first arm and said receptacle.

29. The apparatus of claim 28 further including resilient means reacting between said first and second arms for biasing the outer end of said second arm toward said body.

30. The apparatus of claim 27 further including selectively operable lock means carried by said body for locking said first arm in said inner position.

31. The apparatus of claim 30 wherein said lock means comprises a normally restrained wedge movably mounted on said body adjacent said one end of said first arm, spring means urging said wedge toward said first arm, and frangible release means for enabling said spring means to force said wedge into engagement with said first arm to lock the same in said inner position.

* * * * *